US009731347B2

(12) United States Patent
Kang et al.

(10) Patent No.: US 9,731,347 B2
(45) Date of Patent: Aug. 15, 2017

(54) CORE PIN FOR PREVENTING MOLTEN METAL FROM FLOWING INTO PIPE AND CASTING DEVICE USING THE SAME

(71) Applicants: Hyundai Motor Company, Seoul (KR); Kia Motors Corporation, Seoul (KR)

(72) Inventors: Mun Gu Kang, Gyeonggi-Do (KR); Kwang Min Yoon, Gyeonggi-Do (KR); Tae Ho Jeong, Gyeonggi-Do (KR); Hyung Sop Yoon, Gyeonggi-Do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 198 days.

(21) Appl. No.: 14/620,263

(22) Filed: Feb. 12, 2015

(65) Prior Publication Data

US 2016/0101466 A1 Apr. 14, 2016

(30) Foreign Application Priority Data

Oct. 14, 2014 (KR) ..... 10-2014-0138292

(51) Int. Cl.

| | |
|---|---|
| ***B22D 17/20*** | (2006.01) |
| ***B22D 17/24*** | (2006.01) |
| ***B22C 9/06*** | (2006.01) |

(52) U.S. Cl.

CPC ..... *B22D 17/20* (2013.01); *B22C 9/064* (2013.01); *B22D 17/24* (2013.01)

(58) Field of Classification Search

CPC ..... B22C 9/06; B22C 9/064; B22D 17/20; B22D 17/24; B22D 19/0072

USPC ..... 164/98, 112, 113, 137, 332, 340

See application file for complete search history.

(56) References Cited

U.S. PATENT DOCUMENTS

| | | | | |
|---|---|---|---|---|
| 5,711,364 | A * | 1/1998 | Ota | B22D 17/24 164/113 |
| 5,749,410 | A * | 5/1998 | Uda | F02M 69/465 164/113 |
| 6,739,378 | B2 * | 5/2004 | Sugita | B22D 19/0072 164/112 |

FOREIGN PATENT DOCUMENTS

| | | | |
|---|---|---|---|
| JP | S59189062 | | 10/1984 |
| JP | H04123854 | | 4/1992 |
| JP | H07080042 | B2 | 8/1995 |
| JP | H09253822 | | 9/1997 |
| JP | 2983007 | B2 | 11/1999 |
| KR | 10-2003-0069937 | A | 8/2003 |
| KR | 100680736 | | 2/2007 |

OTHER PUBLICATIONS

Galvanneal Stee, http://www.metropolitandoor.com/docs/PDF/info/Pages%2037%20-%TB%20-%20Galvanneal%20Steel%20-%20062007.pdf, 2007.*

(Continued)

*Primary Examiner* — Kevin E Yoon

(74) *Attorney, Agent, or Firm* — Mintz Levin Cohn Ferris Glovsky and Popeo, P.C.; Peter F. Corless

(57) ABSTRACT

A core pin is provided that prevents a molten metal from flowing into a pipe and a casting device using the same is also provided. The core pin specifically contacts a first end of the pipe inserted into a mold to close the end of the pipe, to thus prevent the molten metal from flowing into the pipe.

4 Claims, 3 Drawing Sheets

(56) References Cited

OTHER PUBLICATIONS

ASTM A653, Standard Specification for Steel Sheet, Zinc-Coated (Galvanized) or Zinc-Iron Alloy-Coated (Galvannealed) by the Hot-Dip Process, ASTM International, 2015.*

* cited by examiner

CORE PIN FOR PREVENTING MOLTEN METAL FROM FLOWING INTO PIPE AND CASTING DEVICE USING THE SAME

CROSS REFERENCE TO RELATED APPLICATION

The present application claims priority to Korean Patent Application No. 10-2014-0138292, filed Oct. 14, 2014, the entire contents of which is incorporated herein for all purposes by this reference.

BACKGROUND

1. Technical Field

The present invention relates to a core pin that prevents a molten metal from flowing into a pipe and a casting device using the same, and more particularly, to a core pin that prevents a molten metal from flowing into a pipe using a ball type core pin, and a casting device using the same.

2. Description of the Related Art

A die casting device is a device used to cast a product having a desired shape by injecting a molten metal into a mold and solidifying the molten metal. A mold that corresponds to a product having a desired shape is required to use a die casting process. Therefore, to obtain a casting in which a pipe is embedded, the pipe should be inserted into and fixed to the mold, and a core pin should be inserted into and fixed to the pipe to prevent a molten metal from entering the pipe. Hereinafter, a process of inserting the core pin into the pipe and performing casting will be described with reference to the accompanying drawings.

As shown in FIG. 1, one end (e.g., a first end) of the core pin C is inserted into a pipe P at one end of the pipe P before performing casting, and an inner diameter of the pipe P is increased due to a rise in a temperature of a mold while performing the casting, to generate a gap G between an inner peripheral surface of the pipe P and an outer peripheral surface of the core pin C. When the gap G is generated, a molten metal flows into the pipe P, to generate a burr in the pipe P during the cooling of the molten metal, thereby causing a potential product defect.

Meanwhile, a distal end of the pipe P is closed by a welding bead B to prevent the molten metal from flowing into the pipe P, as shown in FIG. 2. However, when using the welding bead B, a welded portion should be cut after a welding process and a casting process, which may be difficult. In addition, when performing press working on a distal end in a pressure welded state as shown in FIG. 3, a process of removing the pressure-welded distal end should be performed after the press working.

Meanwhile, a disclosed method of the related art teaches a method of performing a casting work using a mold in which a pipe is embedded. However, even in the related art documents, the above-mentioned problem may not be solved.

The contents described as the related art have been provided merely for assisting in the understanding for the background of the present invention and should not be considered as corresponding to the related art known to those skilled in the art.

SUMMARY

An object of the present invention is to provide a core pin and a casting device using that same that may prevent a molten metal from flowing into a pipe to prevent the molten metal from flowing into the pipe using a ball type core pin and eliminates the need for a separate burr removing process after producing a casting product and a distal end removing process after extraction.

According to an exemplary embodiment of the present invention, a core pin is provided that may prevent a molten metal from flowing into a pipe, contacting one end of the pipe inserted into a mold to close one end of the pipe. The core pin may include: a ball that contacts one end (e.g., a first end) of the pipe; and a fixing pin detachably coupled to the ball. The ball and one end of the fixing pin may be attached to each other via a screw of another fastening mechanism. The ball may have a diameter greater than an inner diameter of the pipe. Any one of molten aluminum and molten magnesium may be injected into the mold, and a material of the ball may be any one of carbon steel and stainless steel. A relationship between the diameter of the ball and the inner diameter of the pipe may satisfy the following Equation:

$$d\times(5/3)\leq D\leq 3d$$

wherein, d is the inner diameter of the pipe and D is the diameter of the ball.

According to another exemplary embodiment of the present invention, a casting device is provided that uses a core pin that may prevent a molten metal from flowing into a pipe. The casting device may include a mold; the pipe inserted into the mold; and the core pin that contacts one end (e.g., a first end) of the pipe inserted into the mold to close one end of the pipe.

The casting device using a core pin may further include a hydraulic cylinder of which one end (e.g., a first end) is fixed, wherein the core pin may be coupled to the other end (e.g., a second end) of the hydraulic cylinder to selectively contact one end portion of an outer diameter of the pipe to fix the pipe. The core pin may include a ball that contacts (e.g., abuts) one end of the pipe and a fixing pin detachably coupled to the ball. The ball and one end of the fixing pin may be attached to each other via a screw or other fastening mechanism. The ball may have a diameter greater than an inner diameter of the pipe.

BRIEF DESCRIPTION OF THE DRAWINGS

The accompanying drawings, which are included to provide a further understanding of the invention and are incorporated in and constitute a part of this application, illustrate exemplary embodiment(s) of the invention and together with the description serve to explain the principle of the invention. In the drawings.

DETAILED DESCRIPTION

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, a core pin that may prevent a molten metal from flowing into a pipe and a casting device using the same according to an exemplary embodiment of the present invention will be described with reference to the accompanying drawings.

Figure 1:
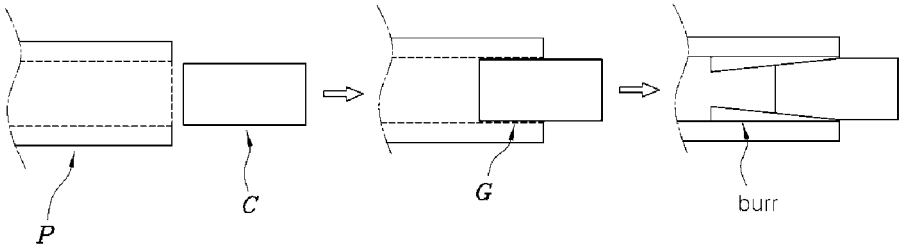
FIG. 1 RELATED ART
FIG. 1 is an exemplary view showing a casting scheme using a general core pin according to the related art.
Figure 2:
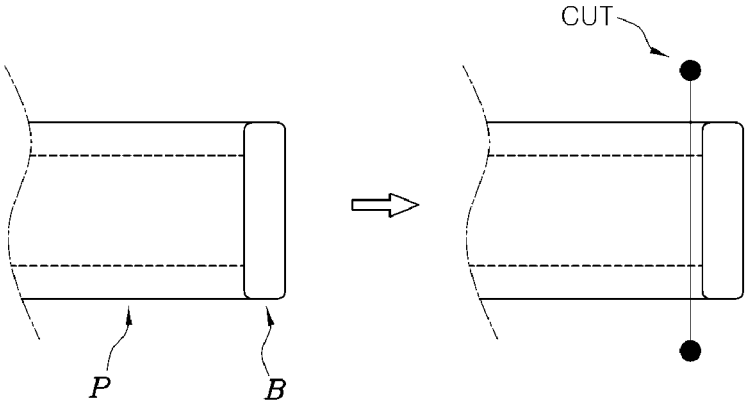
FIG. 2 RELATED ART
FIG. 2 is an exemplary view showing a casting scheme using a welding bead according to the related art.
Figure 3:
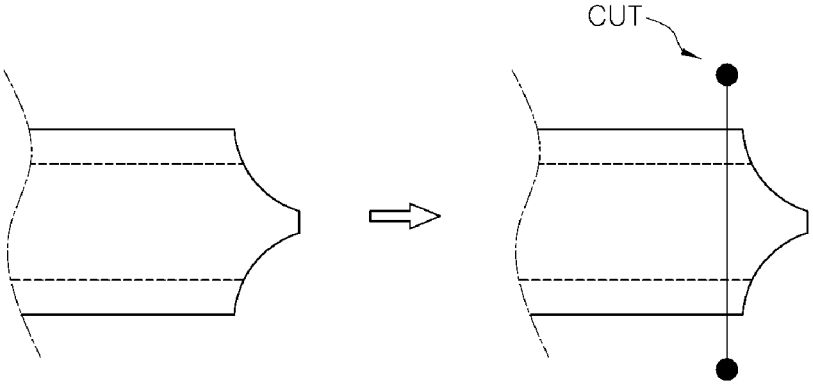
FIG. 3 RELATED ART
FIG. 3 is an exemplary view showing a casting scheme using a pressure-welding scheme according to the related art.
Figure 4:
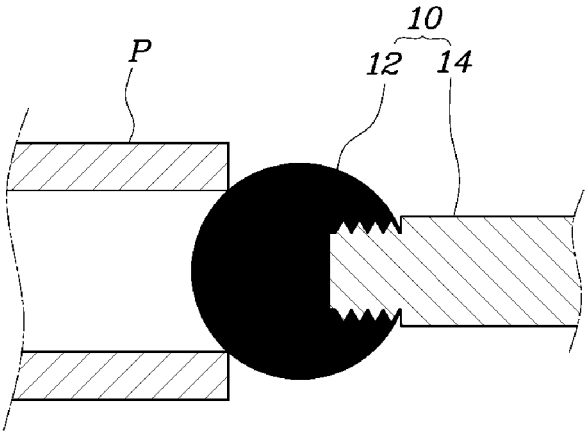
FIG. 4 is an exemplary view showing a core pin that prevents a molten metal from flowing into a pipe according to an exemplary embodiment of the present invention.

As shown in FIG. 4, the core pin that may prevent a molten metal from flowing into a pipe according to an exemplary embodiment of the present invention may contact (e.g., abut) one end (e.g., a first end) of the pipe P inserted into a mold to close the one end of the pipe P. The core pin may include a ball 12 and a fixing pin 14 detachably coupled to the ball 12. The ball 12 may be closely adhered to (e.g., may abut) one end of the pipe P to prevent the molten metal from flowing into an inner diameter of the pipe P. In addition, since the ball 12 and the fixing pin 14 may be detachably coupled to each other, when the ball 12 is to be replaced, for example, when the ball 12 is worn away, the ball 12 may be replaced at any time and be replaced by another ball having a diameter different from that of the ball 12 based on the inner diameter of the pipe P, thereby making it possible to prevent a mold from being modified based on a size of the core pin.

A detachable configuration of the ball 12 and the fixing pin 14 may be variously altered based on a selection of a manufacturer. For example, a process of screwing (e.g., attached) the ball 12 and the fixing pin 14 to each other by forming an aperture in the ball 12, forming a threaded rod on an inner peripheral surface of the ball 12 in which the aperture is formed, and forming a screw thread that corresponds to the threaded rod on an outer peripheral surface of the fixing pin 14 may be applied. Meanwhile, molten aluminum or molten magnesium may be injected into the mold, and carbon steel for machine structural use or stainless steel may be used as a material of the ball 12.

In particular, the carbon steel for machine structural use may contain a composition such as carbon (C), silicon (Si), manganese (Mn), phosphorus (P), sulfur (S), iron (Fe), and the like, and the stainless steel may contain a composition such as C, Si, Mn, P, S, chromium (Cr), nickel (Ni), Fe, and the like. Therefore, ranges of the above-mentioned compositions may be adjusted so that the carbon steel satisfies a material of STKM 11 to 18 and the stainless steel satisfies a material of SUS 304, 316, 416, and 440, thereby maximally securing durability. A diameter of the ball 12 may be variously altered based on the inner diameter of the pipe P and the intention of the manufacturer. In the exemplary embodiment of the present invention, the ball may have a diameter of about 2 to 30 mm.

Additionally, various experiments were conducted to optimize a relationship between the diameter of the ball 12 and the inner diameter of the pipe P for accomplishing an object of the present invention. A relationship between the diameter of the ball 12 and the inner diameter of the pipe P derived from these experiments is as follows.

$$d\times(5/3)\leq D\leq 3d$$

wherein d is the inner diameter of pipe and D is the diameter of ball.

When the diameter of the ball 12 is less than 5/3 of the inner diameter of the pipe P, the ball 12 does not completely close the inner diameter of the pipe P extended by thermal expansion and thus the molten metal may flow into the pipe P and a burr may still be generated at an inner side of the pipe P. When the diameter of the ball 12 is greater than three times the inner diameter of the pipe P, an effect is minimal compared to a cost required for manufacturing the ball 12. Therefore, the relationship between the diameter of the ball 12 and the inner diameter of the pipe P may be adjusted within the above-mentioned range.

Figure 5:
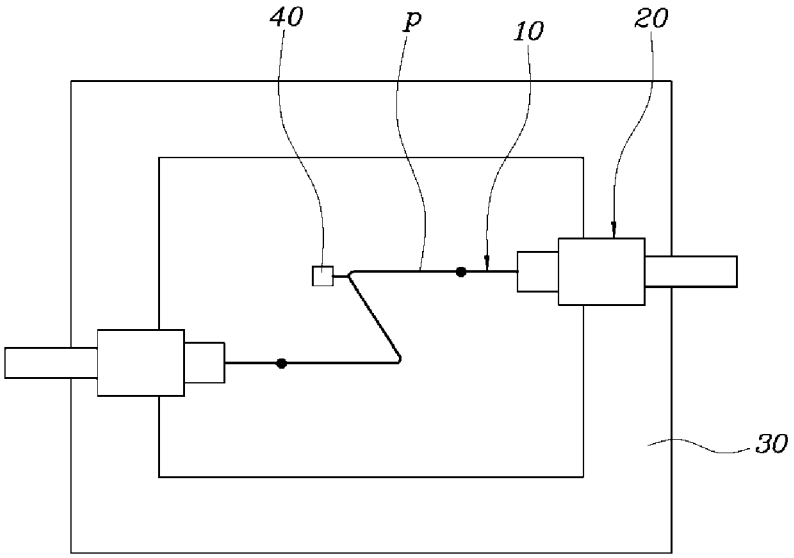
FIG. 5 is an exemplary view showing a casting device using a core pin that prevents a molten metal from flowing into a pipe according to an exemplary embodiment of the present invention.

Meanwhile, as shown in FIG. 5, the casting device using a core pin according to an exemplary embodiment of the present invention may include a mold 30, the pipe P inserted into the mold 30, and the core pin 10 that contacts one end (e.g., a first end) of the pipe P inserted into the mold 30 to close (e.g., to block, to close off, etc.) the one end of the pipe P. Since the core pin 10 is generally similar to the 'core pin that may prevent a molten metal from flowing into a pipe' described above, a detailed description thereof will be replaced by the above-mentioned description.

The mold 30 may be variously designed based on a shape of a final casting product and may have the pipe P embedded therein. The pipe P may be embedded in the mold 30 and maintained in a state in which it is fixed. Therefore, the casting device using a core pin may include a hydraulic cylinder 20 and the core pin 10 to fix the pipe P. The hydraulic cylinder 20 may have one end (e.g., a first end) fixed to the mold 30. A separate structure may also be installed around the mold 30 to fix the hydraulic cylinder 20. The fixing pin 14 of the core pin 10 may be coupled to the other end (e.g., a second end) of the hydraulic cylinder 20. A length of the hydraulic cylinder 20 may be extended and contracted, to cause the ball 12 coupled to a distal end of the fixing pin 14 to selectively close the pipe P, to fix the pipe P or release the fixing of the pipe P.

Meanwhile, it may also be possible to couple a separate clamping member (not shown) rather than the core pin 10 to the hydraulic cylinder 20 and selectively clamp a distal end of the core pin 10 using the clamping member, which may be variously altered based on the intention of the manufacturer. A guide pin 40 may be welded to the pipe P to more firmly fix the pipe P. Since the guide pin 40 protrudes on an outer peripheral surface of the pipe P to allow a transfer robot to clamp the pipe P when a work of moving the pipe P into the mold 30 is performed, the guide pin 40 may be fixed to a fixed side or movable side mold 30 when combining the molds 30 with each other to more firmly fix the pipe P.

According to exemplary embodiments of the present invention, various effects as follow may be obtained due to the above-mentioned technical configuration.

First, even though the pipe is extended due to thermal expansion, the flow of the molten metal into the pipe may be prevented, thereby making it possible to improve a product yield and improve quality of a casting product.

Second, a core pin having balls with various sizes based on an inner diameter of the pipe may be used.

Third, insert die casting product molding of pipes having inner diameters with various sizes with respect to one mold may be possible.

Although the present invention has been shown and described with respect to specific exemplary embodiments, it will be obvious to those skilled in the art that the present invention may be variously modified and altered without departing from the spirit and scope of the present invention as defined by the following claims.

What is claimed is:

1. A casting device, comprising:

a mold into which a pipe is inserted; and a core pin that contacts a first end of the pipe inserted into the mold to close the first end of the pipe and prevent a molten metal from flowing into the pipe, wherein the core pin includes a ball that contacts the first end of the pipe and a fixing pin detachably coupled to the ball.

2. The casting device of claim 1, further comprising:

a hydraulic cylinder having a fixed first end, wherein the core pin is coupled to a second end of the hydraulic cylinder to selectively contact an end portion of an outer diameter of the pipe to fix the pipe.

3. The casting device of claim 1, wherein the ball and a first end of the fixing pin are screwed to each other.

4. The casting device of claim 1, wherein the ball has a diameter greater than an inner diameter of the pipe.

* * * * *